US011656559B2

(12) United States Patent
Yamauchi

(10) Patent No.: US 11,656,559 B2
(45) Date of Patent: May 23, 2023

(54) IMAGE FORMING APPARATUS THAT STOPS VOLTAGE APPLICATION TO A CHARGER BASED ON A CURRENT FLOWING THROUGH AN IMAGE CARRIER MOTOR AFTER EXECUTION OF STOP CONTROL

(71) Applicant: KYOCERA Document Solutions Inc., Osaka (JP)

(72) Inventor: Hironori Yamauchi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/568,777

(22) Filed: Jan. 5, 2022

(65) Prior Publication Data

US 2022/0221808 A1 Jul. 14, 2022

(30) Foreign Application Priority Data

Jan. 8, 2021 (JP) ..... JP2021-001945

(51) Int. Cl.
*G03G 15/06* (2006.01)
*G03G 15/00* (2006.01)
*G03G 15/02* (2006.01)

(52) U.S. Cl.
CPC ..... *G03G 15/065* (2013.01); *G03G 15/0266* (2013.01); *G03G 15/5008* (2013.01)

(58) Field of Classification Search
CPC ..... G03G 15/0266; G03G 15/5008
See application file for complete search history.

(56) References Cited

U.S. PATENT DOCUMENTS 4,696,880 A * 9/1987 Shoji ..... G03G 13/01 430/55
6,064,837 A * 5/2000 Hashimoto ..... G03G 15/09 399/53
2004/0156647 A1* 8/2004 Ishikawa ..... G03G 15/0266 399/167
2016/0048091 A1* 2/2016 Ishii ..... G03G 15/0266 399/50

FOREIGN PATENT DOCUMENTS

JP 2010-026389 2/2010

* cited by examiner

*Primary Examiner* — Arlene Heredia
(74) *Attorney, Agent, or Firm* — Lex IP Meister, PLLC

(57) ABSTRACT

An image forming apparatus includes an image carrier, a charger, a developing member, a motor, a drive controller, and an application controller. The image carrier is rotatably provided. The charger charges the image carrier to a predetermined first polarity by receiving application of a voltage of the first polarity. The developing member develops an electrostatic latent image formed on the image carrier using the toner charged to the first polarity. The motor rotates the image carrier. The drive controller executes stop control for stopping driving of the motor. The application controller stops voltage application to the charger based on a current flowing through the motor after execution of the stop control.

4 Claims, 3 Drawing Sheets

IMAGE FORMING APPARATUS THAT STOPS VOLTAGE APPLICATION TO A CHARGER BASED ON A CURRENT FLOWING THROUGH AN IMAGE CARRIER MOTOR AFTER EXECUTION OF STOP CONTROL

INCORPORATION BY REFERENCE

This application is based upon and claims the benefit of priority from the corresponding Japanese Patent Application No. 2021-001945 filed on Jan. 8, 2021, the entire contents of which are incorporated herein by reference.

BACKGROUND

The present disclosure relates to an image forming apparatus.

An image forming apparatus such as a printer capable of forming an image by an electrophotographic method includes an image carrier, a charger, a developing member, and a motor. The image carrier is rotatably provided. The charger charges the image carrier to a predetermined first polarity by receiving application of a voltage of the first polarity. The developing member develops an electrostatic latent image formed on the image carrier, using the toner charged to the first polarity. The motor rotates the image carrier.

In the image forming apparatus, when stop control for stopping driving of the motor at the time of operation stop and application control for stopping voltage application to the charger are simultaneously executed, the following problems occur. That is, the image carrier rotates by inertia after execution of the stop control. After execution of the application control, the image carrier is conveyed by the inertial rotation to a region where a non-charged region faces the developing member. As a result, the toner is wastefully consumed. On the other hand, it is conceivable that the inertial rotation time of the image carrier is measured in advance, and the voltage application to the charger is stopped after a lapse of a specific time determined based on the measurement result from the execution of the stop control.

However, the inertial rotation time of the image carrier varies depending on the operation state of the image forming apparatus. Therefore, in the above-described configuration, an excess or deficiency occurs in the specific time. If the specific time is too short, toner is wastefully consumed. On the other hand, if the specific time is too long, charging by the charger is performed even after the rotation of the image carrier is stopped, and the image carrier is deteriorated.

An object of the present disclosure is to provide an image forming apparatus capable of suppressing deterioration of an image carrier while suppressing wasteful consumption of toner at the time of operation stop.

SUMMARY

An image forming apparatus according to an aspect of the present disclosure includes an image carrier, a charger, a developing member, a motor, a drive controller, and an application controller. The image carrier is rotatably provided. The charger charges the image carrier to a predetermined first polarity by receiving application of a voltage of the first polarity. The developing member develops an electrostatic latent image formed on the image carrier using the toner charged to the first polarity. The motor rotates the image carrier. The drive controller executes stop control for stopping driving of the motor. The application controller stops voltage application to the charger based on a current flowing through the motor after execution of the stop control.

These and other objects, features and advantages of the present disclosure will become more apparent upon reading of the following detailed description along with the accompanied drawings.

DETAILED DESCRIPTION

Hereinafter, embodiments of the present disclosure will be described with reference to the accompanying drawings. It should be noted that the following embodiments are examples that embody the present disclosure and do not limit the technical scope of the present disclosure.

[Configuration of Image Forming Apparatus 10]

Figure 1:
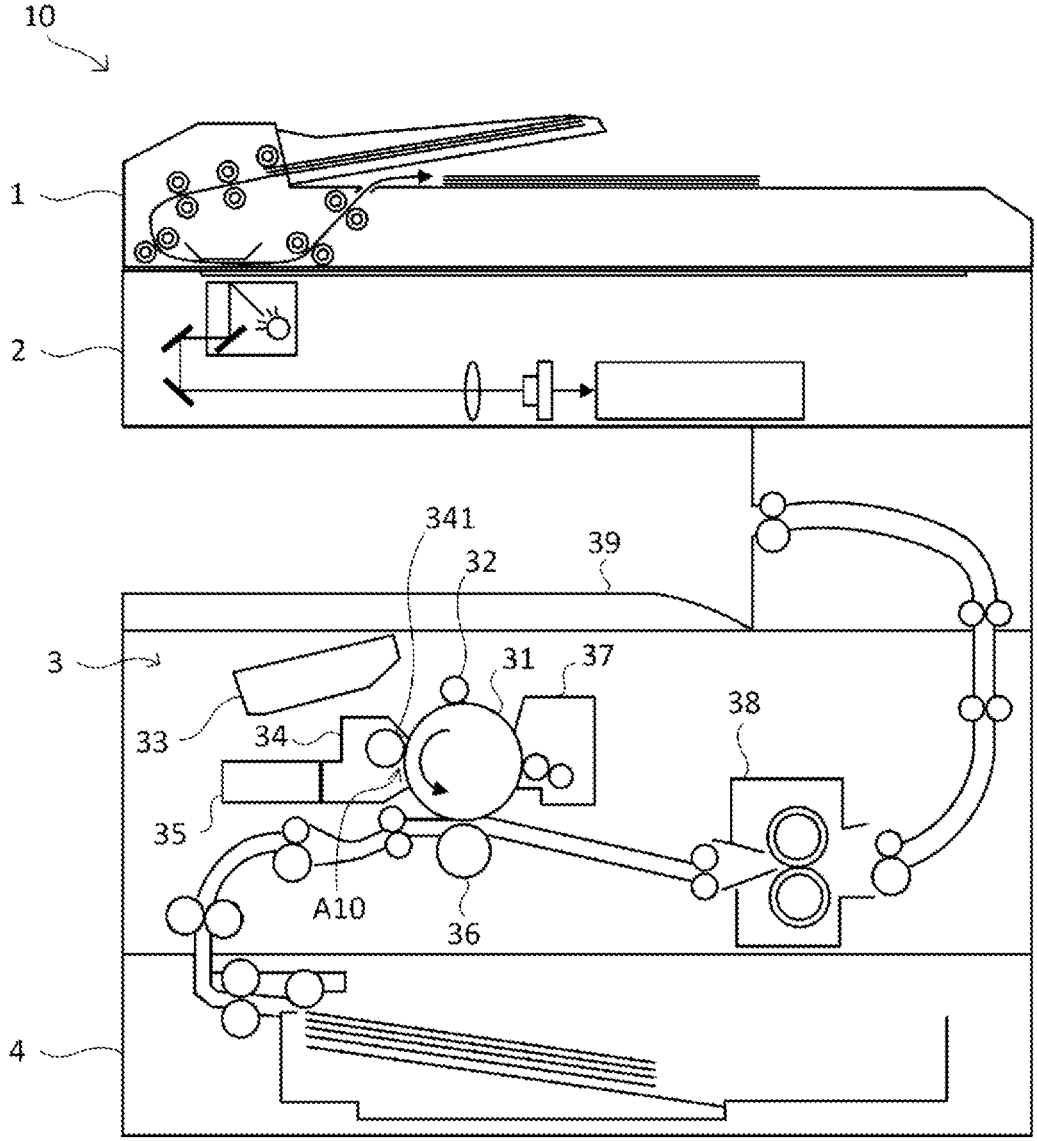
FIG. 1 illustrates a configuration of an image forming apparatus according to an embodiment of the present disclosure.
Figure 2:
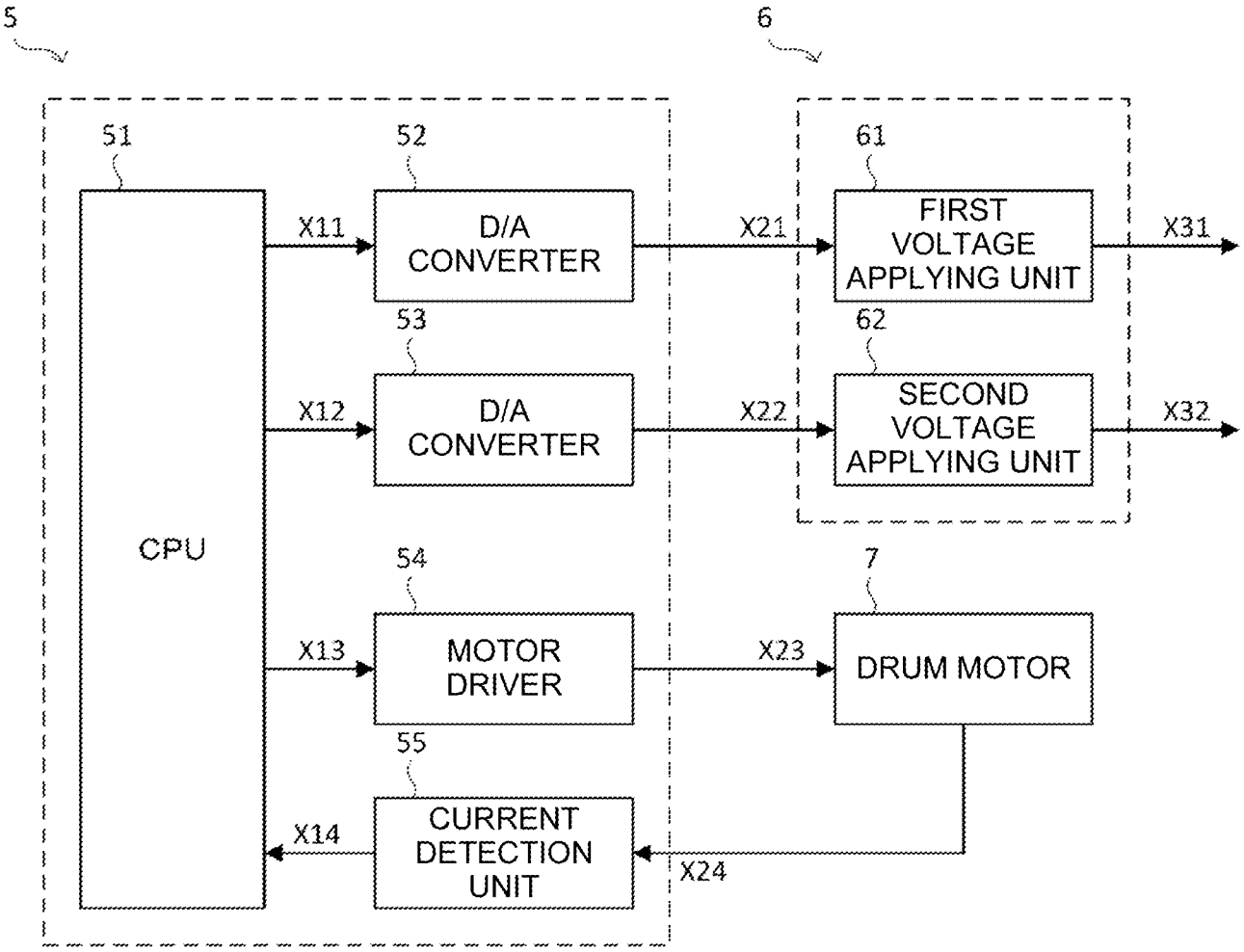
FIG. 2 is a block diagram illustrating configurations of a controller and a high-voltage power supply unit of an image forming apparatus according to an embodiment of the present disclosure.

First, a configuration of an image forming apparatus 10 according to an embodiment of the present disclosure will be described with reference to FIGS. 1 and 2. FIG. 1 is a cross-sectional view showing a configuration of an image forming apparatus 10. In FIG. 2, the controller 5 and the high-voltage power supply unit 6 are indicated by broken lines.

The image forming apparatus 10 is a multifunction peripheral having a plurality of functions such as a scan function of reading image data from a document, a print function of forming an image based on the image data, a facsimile function, and a copy function. The image forming apparatus 10 may be an electrophotographic printer apparatus, a facsimile apparatus, or a copying machine.

As shown in FIGS. 1 and 2, the image forming apparatus 10 includes an automatic document feeder (ADF) 1, an image reading unit 2, an image forming unit 3, a sheet feeding unit 4, a controller 5, a high-voltage power supply unit 6, and a drum motor 7.

The ADF 1 conveys a document to be read by the scan function. The ADF 1 includes a document setting unit, a plurality of document conveying rollers, a document presser, a paper discharge unit, and the like.

The image reading unit 2 realizes the scan function. The image reading unit 2 includes a document table, a light source, a plurality of mirrors, an optical lens, and a charge coupled device (CCD).

The image forming unit 3 realizes the print function. As illustrated in FIG. 1, the image forming unit 3 includes a photosensitive drum 31, a charging roller 32, an optical scanning device 33, a developing device 34, a toner container 35, a transfer roller 36, a cleaning device 37, a fixing device 38, and a sheet discharge tray 39.

The photosensitive drum 31 is rotatably provided. The charging roller 32 is provided in contact with the circumferential surface of the photosensitive drum 31 and charges the circumferential surface of the photosensitive drum 31. For example, the charging roller 32 receives application of a voltage having a positive polarity (an example of a first polarity of the present disclosure) and charges the circumferential surface of the photosensitive drum 31 to the positive polarity. The optical scanning device 33 irradiates the circumferential surface of the photosensitive drum 31 charged by the charging roller 32 with light based on image data. An electrostatic latent image is formed on the circumferential surface of the photosensitive drum 31 by the optical scanning device 33. The photosensitive drum 31 is an example of an image carrier of the present disclosure. The charging roller 32 is an example of a charger of the present disclosure.

The developing device 34 develops the electrostatic latent image formed on the circumferential surface of the photosensitive drum 31. The developing device 34 stores developer including toner and carrier. The developing device 34 stirs the developer by a stirring member (not shown) to frictionally charge toner and carrier contained in the developer. For example, in the image forming apparatus 10, the toner is charged to a positive polarity and the carrier is charged to a negative polarity (an example of a second polarity of the present disclosure). As shown in FIG. 1, the developing device 34 includes a developing roller 341.

The developing roller 341 uses positively charged toner to develop an electrostatic latent image formed on the circumferential surface of the photosensitive drum 31. The developing roller 341 is provided so as to face the circumferential surface of the photosensitive drum 31. The developing roller 341 conveys positively charged toner and negatively charged carriers to a developing region A10 (see FIG. 1) where electrostatic latent images formed on the circumferential surface of the photosensitive drum 31 are developed. The developing region A10 is a region where the circumferential surface of the photosensitive drum 31 and the developing roller 341 face each other. The developing roller 341 develops the electrostatic latent image formed on the circumferential surface of the photosensitive drum 31 by receiving application of a positive voltage. The developing roller 341 is an example of a developing member of the present disclosure. The developing roller 341 may convey only the toner out of the toner and the carriers to the developing region A10.

The toner container 35 supplies toner to the developing device 34. The transfer roller 36 transfers an electrostatic latent image (toner image) developed by the developing device 34 onto a sheet fed by the sheet feeding unit 4. The cleaning device 37 cleans the circumferential surface of the photosensitive drum 31 after the toner image is transferred by the transfer roller 36. The fixing device 38 fixes the toner image transferred to the sheet by the transfer roller 36 to the sheet. The sheet on which the toner image is fixed by the fixing device 38 is discharged to the sheet discharge tray 39.

The sheet feeding unit 4 feeds sheets to the image forming unit 3. The sheet feeding unit 4 includes a sheet feeding cassette, a pickup roller, a sheet feeding roller, a plurality of sheet conveying rollers, and a registration roller.

The controller 5 controls each configuration of the image forming unit 3 and the sheet feeding unit 4. As shown in FIG. 2, the controller 5 includes a CPU 51, a D/A converter 52, a D/A (digital/analog) converter 53, a motor driver 54, and a current detection unit 55. Note that the controller 5 may be a main controller that comprehensively controls the image forming apparatus 10.

The CPU 51 is a processor that executes various types of arithmetic processing. The CPU 51 controls each configuration of the image forming unit 3 and the sheet feeding unit 4 by executing a control program stored in a ROM (not shown).

The D/A converter 52 converts digital electric signals X11 (see FIG. 2) input from the CPU 51 into analog electric signals X21 (see FIG. 2) and outputs the analog electric signals X21. The D/A converter 53 converts digital electric signals X12 (see FIG. 2) input from the CPU 51 into analog electric signals X22 (see FIG. 2) and outputs the analog electric signals X22.

The motor driver 54 drives the drum motor 7 in accordance with a control instruction from the CPU 51. The motor driver 54 applies a drive voltage X23 to the drum motor 7 in accordance with driving signals input from the CPU 51. Further, the motor driver 54 executes stop control for stopping the driving of the drum motor 7 in accordance with stop signals X13 (see FIG. 2) input from the CPU 51. For example, in the stop control, application of the drive voltage X23 is stopped. The motor driver 54 is an example of a drive controller of the present disclosure. The drum motor 7 is an example of a motor according to the present disclosure.

The high-voltage power supply unit 6 generates a high voltage to be applied to each configuration of the image forming unit 3. As shown in FIG. 2, the high-voltage power supply unit 6 includes a first voltage applying unit 61 and a second voltage applying unit 62.

The first voltage applying unit 61 applies a positive applied voltage X31 (see FIG. 2) to the charging roller 32. To be more specific, the first voltage applying unit 61 boosts the voltage of the electric signals X21 input from the D/A converter 52 to generate the applied voltage X31. For example, when the printing process using the image forming unit 3 is executed, the first voltage applying unit 61 outputs the applied voltage X31 of 700 V.

The second voltage applying unit 62 applies a positive applied voltage X32 (see FIG. 2) to the developing roller 341. To be more specific, the second voltage applying unit 62 boosts the voltage of the electric signals X22 input from the D/A converter 53 to generate the applied voltage X32. For example, when the printing process is executed, the second voltage applying unit 62 outputs the applied voltage X32 of 350 V.

The drum motor 7 rotates the photosensitive drum 31.

In the conventional image forming apparatus, when the stop control and the stop of the voltage application to the charging roller 32 are simultaneously executed at the time of stopping the operation, the following problems occur. That is, due to the inertial rotation of the photosensitive drum 31 generated after the stop control is executed, the non-charged region generated on the circumferential surface of the photosensitive drum 31 by the stop of the voltage application to the charging roller 32 is conveyed to the developing region A10, and the toner is wastefully consumed. On the other hand, it is conceivable that the inertial rotation time of the photosensitive drum 31 is measured in advance, and the voltage application to the charging roller 32 is stopped after the elapse of a specific time determined based on the measurement result from the execution of the stop control.

However, the inertial rotation time of the photosensitive drum 31 varies depending on the operation state of the image forming apparatus. Therefore, in the above-described configuration, an excess or deficiency occurs in the specific time. If the specific time is too short, toner is wastefully consumed. On the other hand, if the specific time is too long, charging by the charging roller 32 is performed even after the rotation of the photosensitive drum 31 is stopped, and the photosensitive drum 31 is deteriorated.

On the other hand, in the image forming apparatus 10 according to the embodiment of the present disclosure, as described below, it is possible to suppress deterioration of the photosensitive drum 31 while suppressing wasteful consumption of toner when the operation is stopped.

When the motor current X24 (see FIG. 2) flowing through the drum motor 7 is equal to or less than a predetermined threshold value Y12 (see FIG. 3), the current detection unit 55 outputs a notification signal X14 indicating that the motor current X24 is equal to or less than the predetermined threshold value Y12. For example, the current detection unit 55 includes resistors provided on a current path through which the motor current X24 flows and a comparator that compares a voltage applied to the resistors with a reference voltage corresponding to the threshold value Y12.

The CPU 51 stops the voltage application to the charging roller 32 based on the motor current X24 flowing through the drum motor 7 after executing the stop control. The CPU 51 Is an example of an application controller of the present disclosure.

For example, when the motor current X24 flowing through the drum motor 7 after the stop control is executed is equal to or less than the threshold value Y12, the CPU 51 stops the voltage application by the first voltage applying unit 61. To be specific, when the notification signals X14 are input from the current detection unit 55, the CPU 51 stops voltage application by the first voltage applying unit 61.

For example, the threshold value Y12 is the same value as the motor current X24 at the first timing at which the photosensitive drum 31 that inertially rotates stops after the stop control is executed.

Note that the threshold value Y12 may be the same value as the motor current X24 at the second timing before the photosensitive drum 31 that inertially rotates stops after the stop control is executed. In this case, the second timing is a timing at which the non-charged region generated on the circumferential surface of the photosensitive drum 31 is not conveyed to the developing region A10 by stopping the voltage application by the first voltage applying unit 61 due to the inertial rotation of the photosensitive drum 31 from the second timing until the photosensitive drum 31 is stopped. Further, the threshold value Y12 may be the same value as the motor current X24 at the third timing immediately after the photosensitive drum 31 that inertially rotates is stopped after the stop control is executed.

Further, the CPU 51 may stop the voltage application by the first voltage applying unit 61 when a decrease amount per unit time of the motor current X24 flowing through the drum motor 7 after the stop control is executed is equal to or less than a predetermined reference value. Further, the CPU 51 may determine the stop timing of the voltage application to the charging roller 32 based on the motor current X24 flowing through the drum motor 7 after the stop control is executed. For example, the CPU 51 may stop the voltage application by the first voltage applying unit 61 at a timing when a predetermined time has elapsed after the motor current X24 flowing through the drum motor 7 becomes equal to or less than the threshold value Y12 after the stop control is executed.

Here, the CPU 51 stops the voltage application to the charging roller 32 after stopping the voltage application to the developing roller 341.

For example, the CPU 51 gradually decreases the voltage X32 applied by the second voltage applying unit 62 to stop the voltage application to the developing roller 341, and gradually decreases the voltage X31 applied by the first voltage applying unit 61.

For example, when the printing process is completed, the CPU 51 gradually decreases the voltage X32 applied by the second voltage applying unit 62 from 350 V to 0 V. For example, the CPU 51 gradually reduces the value of the electrical signals X12. As a result, the voltage of the electric signals X22 output from the D/A converter 53 and the applied voltage X32 by the second voltage applying unit 62 also decrease in a stepwise manner.

Further, when the printing process is completed, the CPU 51 decreases the applied voltage X31 by the first voltage applying unit 61 from 700 V to 100 V in a stepwise manner. For example, the CPU 51 gradually reduces the value of the electrical signals X11. As a result, the voltage of the electric signals X21 output from the D/A converter 52 and the applied voltage X31 by the first voltage applying unit 61 also decrease in a stepwise manner.

The CPU 51 may continuously decrease the applied voltage X32 by the second voltage applying unit 62 and the applied voltage X31 by the first voltage applying unit 61.

[Operation Stop Process]

Figure 3:
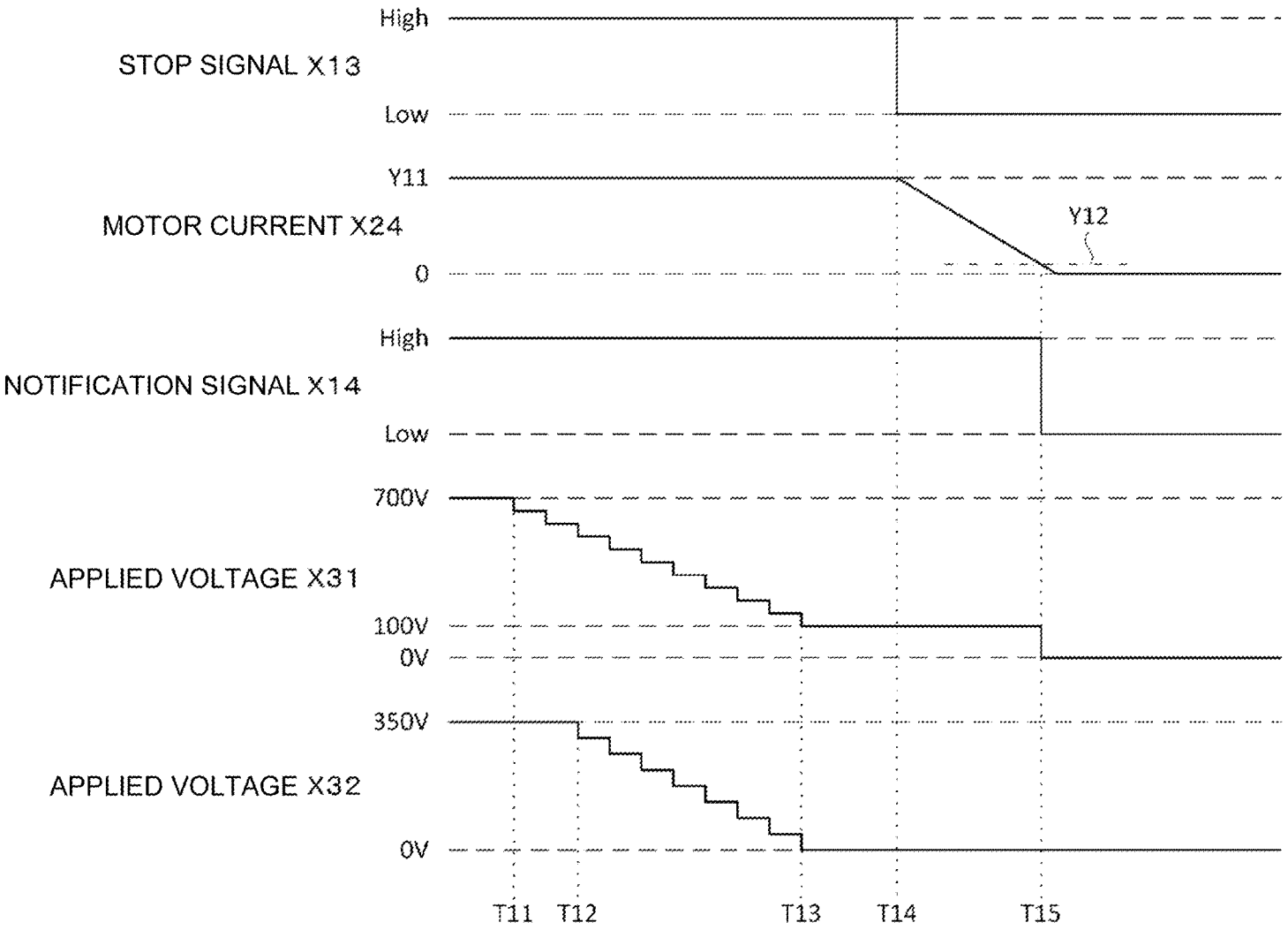
FIG. 3 is a timing chart illustrating a processing procedure of an operation stop process executed by the image forming apparatus according to the embodiment of the present disclosure.

Hereinafter, the operation stop process executed by the image forming apparatus 10 will be described with reference to FIG. 3. FIG. 3 is a timing chart showing output timings of signals during the operation stop process, and changes in the motor current X24, the applied voltage X31, and the applied voltage X32. The operation stop process is executed when the print process is completed.

When the operation stop process is started, the CPU 51 starts a stepwise decrease of the applied voltage X31 by the first voltage applying unit 61 (timing T11 in FIG. 3).

Next, the CPU 51 starts a stepwise decrease of the applied voltage X32 by the second voltage applying unit 62 (timing T12 in FIG. 3). For example, the timing T12 is a timing at which the charged region formed on the circumferential surface of the photosensitive drum 31 by the charging roller 32 at the timing T11 reaches the developing region A10.

As shown in FIG. 3, CPU 51 decreases the applied voltage X31 by the first voltage applying unit 61 in a stepwise manner so that the applied voltage X31 decreases from 700 V to 100 V during a period from the timing T11 to the timing T13. In addition, the CPU 51 decreases the applied voltage X32 by the second voltage applying unit 62 in a stepwise manner such that the applied voltage X32 decreases from 350 V to 0 V during a period from the timing T12 to the timing T13.

As a result, it is possible to stop the voltage application by the second voltage applying unit 62 while avoiding the potential difference between the circumferential surface of the photosensitive drum 31 and the developing roller 341 in the developing region A10 from being larger than that at the time of executing the printing process. Therefore, it is possible to suppress transfer of carriers from the developing roller 341 to the photosensitive drum 31, which is caused by an increase in the potential difference between the circumferential surface of the photosensitive drum 31 and the developing roller 341 in the developing region A10 compared to when the printing process is performed.

Next, CPU 51 asserts the stop signal X13 input to the motor driver 54 (timing T14 in FIG. 3). The stop signals X13 are signals in which a high level indicates invalidity and a low level indicates validity. Thus, the motor driver 54 executes the stop control. Therefore, as shown in FIG. 3, the motor current X24 gradually decreases from the current value Y11 (see FIG. 3) at the time of executing the printing process.

When the motor current X24 becomes equal to or less than the threshold value Y12, the current detection unit 55 asserts the notification signal X14 to be input to CPU 51 (timing T15 in FIG. 3). The high level of the notification signals X14 indicates invalidity, and the low level thereof indicates validity. As a result, the CPU 51 stops voltage application by the first voltage applying unit 61. Thus, as shown in FIG. 3, the applied voltage X31 drops from 100 V to 0 V.

As described above, in the operation stop process, the voltage application to the charging roller 32 is stopped based on the motor current X24 flowing through the drum motor 7 after the stop control is executed. Here, it can be said that the motor current X24 flowing through the drum motor 7 after the stop control is executed indicates the rotation state (rotation speed) due to the inertial rotation of the photosensitive drum 31 after the stop control is executed. That is, the image forming apparatus 10 can determine the stop timing of the voltage application to the charging roller 32 based on the rotation state due to the inertial rotation of the photosensitive drum 31 after the execution of the stop control. Therefore, it is possible to suppress deterioration of the photosensitive drum 31 while suppressing wasteful consumption of toner at the time of operation stop.

Further, in the operation stop process, after the voltage application by the second voltage applying unit 62 is stopped, the voltage application by the first voltage applying unit 61 is stopped. Thus, compared to a configuration in which voltage application by the second voltage applying unit 62 is not stopped before voltage application by the first voltage applying unit 61 is stopped, it is possible to suppress transfer of toner from the developing roller 341 to the photosensitive drum 31 when voltage application by the first voltage applying unit 61 is stopped.

What is claimed is:

1. An image forming apparatus comprising:

an image carrier that is rotatably provided;

a charger that charges the image carrier to a predetermined first polarity by receiving application of a voltage of the first polarity; and a developing member that develops an electrostatic latent image formed on the image carrier using toner charged to the first polarity;

a motor that rotates the image carrier;

a drive controller that executes stop control for stopping driving of the motor; and an application controller that stops voltage application to the charger and the developing member, wherein in a case where the stop control is to be executed by the drive controller, the application controller gradually reduces voltage applied to the charger and voltage applied to the developing member, stops the voltage application to the developing member when the voltage applied to the charger is reduced to a specific value, and stops the application of the voltage of the specific value to the charger in accordance with a current flowing through the motor after execution of the stop control reaching a predetermined threshold value.

2. The image forming apparatus according to claim 1, wherein;

the predetermined threshold value is determined according to a timing before the rotation of the image carrier is stopped and at which a non-charged region generated on the image carrier by the stop of the voltage application to the charger is not conveyed to a developing region where the electrostatic latent image is developed by the rotation of the image carrier.

3. The image forming apparatus according to claim 1, wherein;

the developing member develops the electrostatic latent image by receiving the application of the voltage of the first polarity, and;

the application controller stops the application of voltage to the charger after stopping the application of voltage to the developing member.

4. The image forming apparatus according to claim 3, wherein the developing member conveys the toner and a carrier charged to a second polarity opposite to the first polarity, to a developing region where the electrostatic latent image is developed.

* * * * *